US009457612B2

(12) United States Patent
Ghorbanloo

(10) Patent No.: US 9,457,612 B2
(45) Date of Patent: Oct. 4, 2016

(54) SYSTEM AND A METHOD FOR DRAWING ARCS AND CIRCLE

(71) Applicant: Farhad Ghorbanloo, Zanjan (IR)

(72) Inventor: Farhad Ghorbanloo, Zanjan (IR)

( * ) Notice: Subject to any disclaimer, the term of this patent is extended or adjusted under 35 U.S.C. 154(b) by 0 days.

(21) Appl. No.: 15/062,969

(22) Filed: Mar. 7, 2016

(65) Prior Publication Data

US 2016/0185153 A1 Jun. 30, 2016

Related U.S. Application Data

(63) Continuation-in-part of application No. 14/877,123, filed on Oct. 7, 2015, now Pat. No. 9,308,771.

(51) Int. Cl.
*B43L 9/00* (2006.01)
*B43L 9/04* (2006.01)

(52) U.S. Cl.
CPC . *B43L 9/04* (2013.01); *B43L 9/005* (2013.01)

(58) Field of Classification Search
CPC ..... B43L 9/00; B43L 9/04; B43L 9/005
USPC ..... 33/27.02, 27.03, DIG. 21
See application file for complete search history.

(56) References Cited

U.S. PATENT DOCUMENTS

| | | | | |
|---|---|---|---|---|
| 1,629,143 | A * | 5/1927 | Bungart | B43L 9/04 33/27.03 |
| 3,103,070 | A * | 9/1963 | Looker | B43L 9/04 33/27.03 |
| 6,425,186 | B1 * | 7/2002 | Oliver | G01C 15/02 33/264 |
| 8,966,776 | B2 * | 3/2015 | Kelly | G01C 15/12 33/286 |
| 2015/0168953 | A1 * | 6/2015 | Smid | G05D 1/028 701/28 |
| 2016/0023502 | A1 * | 1/2016 | Ghorbanloo | B43L 9/005 33/27.03 |

* cited by examiner

*Primary Examiner* — Yaritza Guadalupe-McCall
(74) *Attorney, Agent, or Firm* — Barry Choobin; Patent 360

(57) ABSTRACT

The embodiments herein disclose a compass device for drawing arcs and circles without the need for accessing the center. The device comprises a chassis fixed with two guide wheels at two ends. A protractor is fixed to the guide wheel for setting an angle for the wheel. An offset wheel is installed under the offset axis frame mounted with a tool holder and arranged perpendicular to the chassis. A laser pointer is mounted on the offset axis frame for identifying a desired part of the arcs and circles. A balance wheel is attached to the balance base for maintaining a stability of the compass. A marker is inserted in a tool holder for marking the arcs and circles. The device is configured to vary an angle of the angled wheel continuously to change a curvature of radius at every instant in a curve.

18 Claims, 18 Drawing Sheets

SYSTEM AND A METHOD FOR DRAWING ARCS AND CIRCLE

CROSS-REFERENCE TO RELATED APPLICATION

The embodiments herein claims the priority of a U.S. patent application Ser. No. 14/877,123 filed on Oct. 7, 2015 and entitled, "A SYSTEM AND A METHOD FOR DRAWING ARCS AND CIRCLE" and the contents of which are included in entirety as reference herein.

BACKGROUND

1. Technical Field

The embodiments herein are generally related to devices and instruments used in geometry. The embodiments herein are particularly related to a measuring and drawing instruments. The embodiments herein are more particularly related to a compass used for drawing arcs and circles in a flat or in a relatively flat surface, without a need to have access to the center, and without a need to control by an external framework. The embodiments herein are especially related to a compass used for drawing multiple arcs, and curves in a flat or in a relatively flat surface, without a need to have access to the center and without a need to control by an external framework.

2. Description of the Related Art

Drawing and measuring instruments are invented for measuring physical quantities and comparing physical quantities of the real-world objects and events. A compass is an essential drawing instrument that is used for inscribing circles and arcs.

Today compasses are used in almost all the industries. However, the conventional compasses are not usable when the radius is very large and the center is not accessible. Further, the conventional compasses are not feasible to use when there is a barrier between the center and the arc. The use of the conventional compasses in the above-mentioned circumstances are complex, time-consuming and inefficient.

Hence, there is a need for a drawing tool that is capable of drawing the arcs and circles without the need for accessing the center. Further, there is a need for a drawing tool that is capable of drawing arcs and circles for large radius. Still further, there is a need for a drawing tool that is capable of drawing arcs and circles when there is a barrier between the center and the arc. Yet there is a need for a drawing tool that is capable of drawing arcs, circles and curves in a flat and relatively flat surfaces without a need for a control by an external framework. Yet there is a need for a drawing tool that is capable of drawing arcs, circles and curves in a flat and relatively flat surfaces to vary a radius of at any instant. Yet there is a need for a drawing tool that is capable of drawing multiple arcs, and curves in a flat and relatively flat surfaces without a need for a control by an external framework.

The above-mentioned shortcomings, disadvantages and problems are addressed herein and which will be understood by reading and studying the following specification.

OBJECTS OF THE EMBODIMENTS HEREIN

The primary object of the embodiments herein is to provide a compass for drawing the arcs and circles in a flat surface or in a relatively flat surface without the need for accessing the center.

Another object of the embodiment herein is to provide a compass for drawing the arcs and circles for a relatively larger radius.

Yet another object of the embodiment herein is to provide a compass for drawing the arcs and circles even when there are barriers between the center and the arc.

Yet another object of the embodiments herein is to provide a compass for drawing the arcs and circles when the center is suspended in the space.

Yet another object of the embodiments herein is to provide a compass or a drawing tool that is capable of drawing arcs, circles and curves in a flat and relatively flat surfaces without a need for a control by an external framework.

Yet another object of the embodiments herein is to provide a compass or a drawing tool that is capable of drawing arcs, circles and curves in a flat and relatively flat surfaces to vary a radius of at any instant.

Yet another object of the embodiments herein is to provide a compass or a drawing tool that is capable of drawing multiple arcs, and curves in a flat and relatively flat surfaces without a need for a control by an external framework.

These and other objects and advantages of the embodiments herein will become readily apparent from the following detailed description taken in conjunction with the accompanying drawings.

SUMMARY

The various embodiments herein provide a compass device for drawing arcs and circles without a need for accessing the center. According to an embodiment herein, the compass comprises a chassis for providing a framework for a plurality of components of the compass. The chassis is mounted with two guide wheels at two opposite ends. A first guide wheel is configured for initiating a movement of the compass. The first guide wheel is installed at one end of the chassis. The first guide wheel is an angled wheel. The angle of the first guide wheel is set by a user. A second guide wheel is configured for enabling a movement of the compass. The second guide wheel is attached to another end of the chassis. The second guide wheel is a fixed wheel. A protractor is configured for setting an angle for the first guide wheel. The protractor is mounted on the chassis. An offset axis frame is attached to the chassis for providing a framework for a plurality of components of the compass. The offset axis frame is installed perpendicular to the chassis next to the second guide wheel. A tool holder is provided for holding a marking device. The tool holder is mounted on the offset axis frame. The tool holder is adjusted on the offset axis frame using an indicator. The tool holder is adjusted on the offset axis frame using a clip. An offset wheel is arranged for providing a balance for the compass. The offset wheel is installed under the offset axis frame. A laser pointer is provided for identifying a desired part of the arcs and circles. The laser pointer is mounted on the offset axis frame. The laser pointer is placed at a symmetry center of the second guide wheel. A balance base is attached to the chassis for maintaining a stability of the compass. The balance base is arranged perpendicular to the chassis. A balance wheel is attached to the balance base. The balance wheel is installed under the balance base. The balance base and the balance wheel are configured to prevent an imbalance of the compass. A marker is provided for marking the arcs and circles. The marker is inserted in a tool holder. The marker is controlled by adjusting the tool holder.

According to an embodiment herein, a controller for tool holder position on the offset axis frame is provided. The automatic controller for tool holder position on the offset axis frame is mounted on the tool holder. The automatic controller for tool holder position comprises a sensor and a first drive motor. The automatic controller for tool holder position on the offset axis frame is configured to control an operation of the first drive motor to move the tool holder to a desired position on the offset axis frame based on an output of the sensor.

According to an embodiment herein, a controller for the angled wheel is provided. The controller for angled wheel is mounted on the chassis above the angle wheel. The controller for angled wheel is configured to vary an angle of the angled wheel continuously to change a curvature of radius at every instant in a curve. The controller for the angled wheel comprises a second drive motor and a friction gear box.

According to an embodiment herein, an encoder or numerical coder mounted on the second guide wheel and configured to calculate a longitude or length of a curved line to calculate a curvature of radius at every instant.

According to an embodiment herein, a microcontroller is mounted on the chassis and configured to control an operation of compass device to draw a desired curve.

According to an embodiment herein, the compass is used for drawing arcs and circles for a flat surface.

According to an embodiment herein, the compass is used for drawing arcs and circles in a relatively flat surface.

According to an embodiment herein, the offset axis frame includes a ruled groove. The ruled groove on the offset axis frame is dependent on a scale of the compass.

According to an embodiment herein, the first guide wheel and the second guide wheel are installed using standard welding techniques.

According to an embodiment herein, the offset axis frame is configured to regulate a distance between the tool holder and the chassis.

According to an embodiment herein, the laser pointer is configured for aligning the radius of the arc with a desired point.

According to an embodiment herein, the balance base and the balance wheel are configured for balancing the compass.

According to an embodiment herein, the balance base and the balance wheel are configured to maintain a symmetry plane of the guide wheel perpendicular to a surface of the ground.

According to an embodiment herein, a profile of the first guide wheel and the second guide wheel is semi-circular.

According to an embodiment herein, the ruled groove has a ruled section and wherein the ruled section is calibrated to indicate a distance between a mark left by the tool and a contact point of the second guide wheel with a ground surface.

According to an embodiment herein, a range of the compass is calculated using a formula $m=r/a$, wherein m is a multiplication factor, r is a radius of arc or circle and a is a distance between a symmetry center of the first guide wheel and the second guide wheel, and wherein the value of m is equal to 57.2899.

According to an embodiment herein, the laser pointer is installed on the chassis in such a way that an emission line of the laser pointer is parallel to a direction of radius of the arc.

According to an embodiment herein, the sensor in the automatic controller for tool holder position on the offset axis frame is configured to detect a position of the tool holder on the offset axis frame.

According to an embodiment herein, the second drive motor is operated to vary the angle of the angled wheel. The controller for the angled wheel is configured to control an operation of the second drive motor to vary the angle of the wheel at every instant.

According to an embodiment herein, the protractor is configured to provide a feedback of the angle of the angled wheel to the controller.

According to an embodiment herein, the friction gear box comprises a plurality of friction gear wheels to select a friction of the angled wheel to change the angle of the angled wheel without any vibration and sliding movement.

According to an embodiment herein, the automatic controller for tool holder position on the offset axis frame is further configured to calculate a movement speed of the tool holder on the offset axis frame.

The embodiments herein provide a compass device and a method for drawing arcs and circles without the need for accessing the center. The compass comprises a chassis, a first guide wheel, a second guide wheel, a protractor, an offset axis frame, an offset wheel, a laser index, a balance base, a balance wheel, a tool holder, and a marker.

According to an embodiment herein, the chassis is used for providing a framework for a plurality of other components of the compass.

According to an embodiment herein, the first guide wheel is used for initiating a movement of the compass. The first guide wheel is installed at one end of the chassis. According to an embodiment herein, the first guide wheel is referred as an angled wheel and the angle for the movement of the guide wheel is set by a user.

According to an embodiment herein, the second guide wheel is used for the movement of the compass. According to an embodiment herein, the second guide wheel is fixed.

According to an embodiment herein, the protractor is used for setting the angle for the first guide wheel. The protractor is mounted on the chassis.

According to an embodiment herein, the offset axis frame is used for providing a framework for a plurality of components of the compass. The offset axis frame is installed perpendicular to the chassis and next to the second guide wheel.

According to an embodiment herein, a tool holder is used for holding a marking device. The marking device is mounted on the offset axis frame and adjusted using an indicator. The tool holder is adjusted on the offset axis frame using a clip.

According to an embodiment herein, the offset wheel is used for providing a balance for the compass. The offset wheel is installed under the offset axis frame.

According to an embodiment herein, the laser index is used for identifying the desired parts of the arcs and circles. The laser index is mounted on the offset axis frame. Further, the laser index is placed at the symmetry center of the second guide wheel.

According to an embodiment herein, the balance base is used for maintaining the stability of the compass. The balance base is placed perpendicular to the chassis.

According to an embodiment herein, the balance wheel is attached to the balance base. The combination of the balance base and the balance wheel prevents the imbalance of the compass.

According to an embodiment herein, a marker is used for marking arcs and circles. The marker is inserted in a tool holder, and the position of the marker is adjusted by adjusting the tool holder.

According to an embodiment herein, the compass is used for drawing arcs and circles in a flat surface.

According to an embodiment herein, the compass is used for drawing arcs and circles in a relatively flat surfaces.

According to an embodiment herein, the offset axis frame includes a ruled groove, and the grooves on the offset axis are dependent on the scaling level of the compass.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
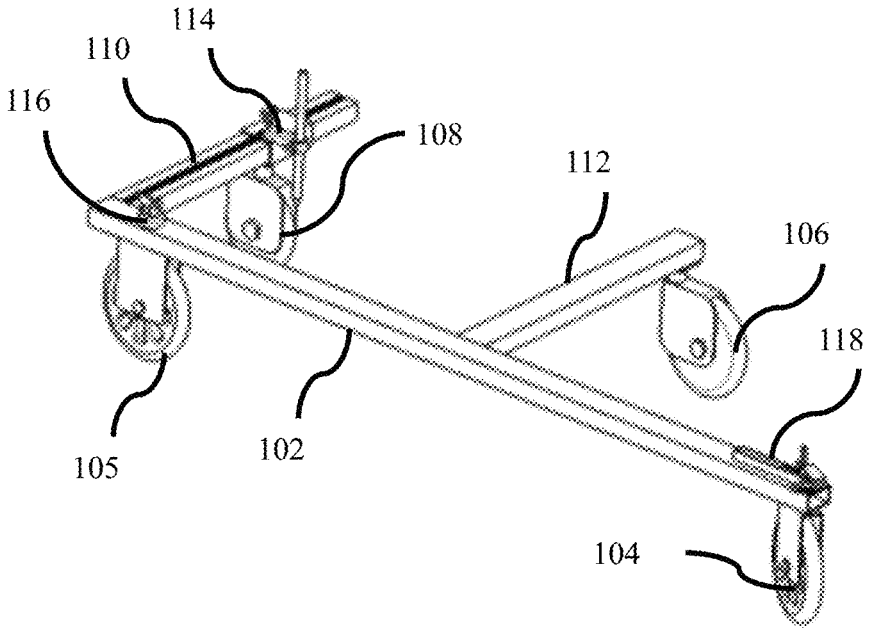
FIG. 1 illustrates a top side perspective view of a compass device, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a compass device for drawing arcs and circles without a need for accessing the center. According to an embodiment herein, the compass comprises a chassis for providing a framework for a plurality of components of the compass. The chassis is mounted with two guide wheels at two opposite ends. A first guide wheel is configured for initiating a movement of the compass. The first guide wheel is installed at one end of the chassis. The first guide wheel is an angled wheel. The angle of the first guide wheel is set by a user. A second guide wheel is configured for enabling a movement of the compass. The second guide wheel is attached to another end of the chassis. The second guide wheel is a fixed wheel. A protractor is configured for setting an angle for the first guide wheel. The protractor is mounted on the chassis. An offset axis frame is attached to the chassis for providing a framework for a plurality of components of the compass. The offset axis frame is installed perpendicular to the chassis next to the second guide wheel. A tool holder is provided for holding a marking device. The tool holder is mounted on the offset axis frame. The tool holder is adjusted on the offset axis frame using an indicator. The tool holder is adjusted on the offset axis frame using a clip. An offset wheel is arranged for providing a balance for the compass. The offset wheel is installed under the offset axis frame. A laser pointer is provided for identifying a desired part of the arcs and circles. The laser pointer is mounted on the offset axis frame. The laser pointer is placed at a symmetry center of the second guide wheel. A balance base is attached to the chassis for maintaining a stability of the compass. The balance base is arranged perpendicular to the chassis. A balance wheel is attached to the balance base. The balance wheel is installed under the balance base. The balance base and the balance wheel are configured to prevent an imbalance of the compass. A marker is provided for marking the arcs and circles. The marker is inserted in a tool holder. The marker is controlled by adjusting the tool holder.

According to an embodiment herein, a controller for tool holder position on the offset axis frame is provided. The automatic controller for tool holder position on the offset axis frame is mounted on the tool holder. The automatic controller for tool holder position comprises a sensor and a first drive motor. The automatic controller for tool holder position on the offset axis frame is configured to control an operation of the first drive motor to move the tool holder to a desired position on the offset axis frame based on an output of the sensor.

According to an embodiment herein, a controller for the angled wheel is provided. The controller for angled wheel is mounted on the chassis above the angle wheel. The controller for angled wheel is configured to vary an angle of the angled wheel continuously to change a curvature of radius at every instant in a curve. The controller for the angled wheel comprises a second drive motor and a friction gear box.

According to an embodiment herein, an encoder or numerical coder mounted on the second guide wheel and configured to calculate a longitude or length of a curved line to calculate a curvature of radius at every instant.

According to an embodiment herein, a microcontroller is mounted on the chassis and configured to control an operation of compass device to draw a desired curve.

According to an embodiment herein, the compass is used for drawing arcs and circles for a flat surface.

According to an embodiment herein, the compass is used for drawing arcs and circles in a relatively flat surface.

According to an embodiment herein, the offset axis frame includes a ruled groove. The ruled groove on the offset axis frame is dependent on a scale of the compass.

According to an embodiment herein, the first guide wheel and the second guide wheel are installed using standard welding techniques.

According to an embodiment herein, the offset axis frame is configured to regulate a distance between the tool holder and the chassis.

According to an embodiment herein, the laser pointer is configured for aligning the radius of the arc with a desired point.

According to an embodiment herein, the balance base and the balance wheel are configured for balancing the compass.

According to an embodiment herein, the balance base and the balance wheel are configured to maintain a symmetry plane of the guide wheel perpendicular to a surface of the ground.

According to an embodiment herein, a profile of the first guide wheel and the second guide wheel is semi-circular.

According to an embodiment herein, the ruled groove has a ruled section and wherein the ruled section is calibrated to indicate a distance between a mark left by the tool and a contact point of the second guide wheel with a ground surface.

According to an embodiment herein, a range of the compass is calculated using a formula $m=r/a$, wherein m is a multiplication factor, r is a radius of arc or circle and a is a distance between a symmetry center of the first guide wheel and the second guide wheel, and wherein the value of m is equal to 57.2899.

According to an embodiment herein, the laser pointer is installed on the chassis in such a way that an emission line of the laser pointer is parallel to a direction of radius of the arc.

According to an embodiment herein, the sensor in the automatic controller for tool holder position on the offset axis frame is configured to detect a position of the tool holder on the offset axis frame.

According to an embodiment herein, the second drive motor is operated to vary the angle of the angled wheel. The controller for the angled wheel is configured to control an operation of the second drive motor to vary the angle of the wheel at every instant.

According to an embodiment herein, the protractor is configured to provide a feedback of the angle of the angled wheel to the controller.

According to an embodiment herein, the friction gear box comprises a plurality of friction gear wheels to select a friction of the angled wheel to change the angle of the angled wheel without any vibration and sliding movement.

According to an embodiment herein, the automatic controller for tool holder position on the offset axis frame is further configured to calculate a movement speed of the tool holder on the offset axis frame.

According to an embodiment herein, a method and a system are provided for drawing curves in flat and relatively flat surfaces without need to control by external frame work.

According to an embodiment herein, the compass without a need to access center of arc is provided to vary a value of radius in instant, so this device is set at any desired value of radius at each point of motion. As a result a curve is drawn so that the curvature radius at each point of the curve, is equal to a radius of compass device which is set at that point. For drawing definite curve by this compass device, the relation of curvature radius of curve with along a line of motion is determined.

According to an embodiment herein, the compass device is added with a an automatic controller and regulator for varying an angle of the angled wheel at an instant, an automatic controller for positioning a tool holder at any desired place on the offset axis frame, an encoder or a numerical coder for calculating a longitude or a length of a curve line for varying the angle of the angled wheel, a microprocessor for automatically controlling all the components in the compass device without access to center of arc', a compass device is developed to draw multiple curves without need to be control by external framework on flat and relatively flat surfaces.

According to an embodiment herein, the automatic regulator and controller of angle of angled guide wheel is provided to vary an angle of the angled wheel to any desired value at every instant. The compass device (curve drawer) without a need to be controlled by external framework is configured to change the curvature radius in instant so the angle of angled guide wheel is not constant and the angle is changed ceaselessly/continuously. The angle regulator is installed on the vertical shaft of angled guide wheel.

According to an embodiment herein, the automatic regulator and controller of angle of angled guide wheel is provided with a drive motor, a protractor and friction gear box.

According to an embodiment herein, the drive motor is mounted on eth angled wheel. The drive motor is configured for changing the value of angle automatically.

According to an embodiment herein, the protractor is installed at the vertical shaft of angled wheel. The protractor is configured for providing a feedback of drive motor operation and a friction gear box.

According to an embodiment herein, the friction gear box is designed for a reduction of the rotation speed of drive motor. The friction gear box is designed to reduce a speed of rotation of the driver motor by a factor of 1/10000, a plurality of friction gear wheels are provided to reduce a speed of rotation of the driver motor by a factor of 1/10000. The gearbox is designed to enable the automatic regulator of angle to have a precision within an acceptable range/limit. The gear box is configured and operated to change the angle of angled wheel is changed without any vibration and sliding movement.

According to an embodiment herein, a driver motor is configured to automatically control a movement of the angled wheel.

According to an embodiment herein, an N-coder or numerical coder or encoder is installed on the fixed guide wheel. The N-coder or numerical coder or encoder is configured and designed to calculate a or length of a curved line/arc at any instant and speed of movement of the compass device motion, as the value of angle of angled wheel depends on the value of curvature radius, and value of curvature radius depends on the curved line/arc.

According to an embodiment herein, an automatic Regulator/controller for positioning a tool holder at any desired position on the offset axis frame at every instant is provided. The automatic Regulator/controller for positioning a tool holder comprises an electrical motor and a sensor. The electrical motor and the sensor are installed on the tool holder. The automatic Regulator/controller is designed to move the tool holder on the offset axis and control the positioning of the tool holder on the offset axis by the electrical motor based on the sensor output. The automatic Regulator/controller is further configured to calculate the speed of tool holder movement motion on the axis center.

According to an embodiment herein, a control system is provided to control or regulate an operation of all of the components provided in the compass device and are explained in previous sections. The control system comprises a microprocessor which is installed in a box. The microcontroller is communicatively connected to each component in the compass device. The microcontroller is configured to receive an input data about a desired curve as input and processes these data. The microcontroller/microprocessor is configured to control an operation of each component in eth compass device based on the processed data to obtain a desired curve.

Each curve is defined as follows:

In perpendicular coordinates, the curve is defined as y=f(x).

In polar coordinates, the curve is defined as r=f (θ)

So the radius of curvature is defined as follows:

In perpendicular coordinates, the radius of curvature is defined as $$\rho = \frac{(1+y'^2)^{\frac{3}{2}}}{y''}$$

In polar coordinates, the radius of curvature is defined as

In perpendicular coordinates $$y=f(x)$$

In polar coordinates $$r=f(\theta)$$

So the curvature radius will be as follow:

In perpendicular coordinates $$\rho = \frac{(1+y'^2)^{\frac{3}{2}}}{y''}$$

In polar coordinates $$\rho = \frac{(r^2+r'^2)^{\frac{3}{2}}}{r^2+2r'^2+rr''}$$

Which $$y' = \frac{dy}{dx},\ y'' = \frac{d^2y}{dx^2} \text{ and } r' = \frac{dr}{d\theta},\ r'' = \frac{d^2r}{d\theta^2}$$

The value of longitude of curve line S can be determined as follow:

$$S=\int\sqrt{1+y'^2}dx$$

Or $$S=\int\sqrt{r^2+r'^2}d\theta$$

So ρ is definable as function of S:

$$\rho=g(s)$$

The function g is vary for each curve and can be determined analytical and numerical methods. After determining the relation between ρ and S, this formula is given to the processor package as an input The relation between angle of angled wheel α and ρ is as follow:

$$\alpha = \tan^{-1}\left(\frac{a}{\rho+b}\right)$$

The distance of the mark left by the tools from the symmetric center of the fixed wheel equals b and the distance between the symmetry center of the guide wheels equals a. So result of these explanations is this relation:

$$\rho = g(s),\ \alpha = \tan^{-1}\left(\frac{a}{\rho+b}\right) \Rightarrow \alpha = \tan^{-1}\left(\frac{a}{g(s)+b}\right)$$

It means the value of angle of angled wheel is function of S. The speed of change of angle is determined as follow:

$$\dot{\alpha} = \frac{d\alpha}{dt} = \frac{d\alpha}{dS}\times\frac{dS}{dt} = \frac{d\alpha}{dS}\times\dot{S}$$

$$\dot{\alpha} = \frac{1}{1+\left(\frac{a}{g(S)+b}\right)^2}\times\frac{-g'(S)}{(g(S)+b)^2}\times\dot{S}$$

$$\dot{S} = \frac{dS}{dt}$$

Which t=time

It means that the speed of change of angle depends on the value of S and changing of value of S with respect to the time rating.

Values of S and Ś have been calculated by N-coder and these values have been given to processor and processor with respect to these values and relation of $\alpha$ and $\acute{\alpha}$ regulate value of these parameters.

Processor is programmed with respect to these relations and parameters.

According to an embodiment herein, a method for drawing multiple curves and an arc with variable curvature of radius at every instant using the compass device is provided. In the first step, a relation between S and $\rho$ for any desired curve, and an information about start point and end point of desired curve are received by the microprocessor. In the second step, the other relations such as the relation between $\acute{\alpha}$, Ś and S are calculated by the microprocessor. In the third step, an angle of angled wheel for the start point of a desired curve is controlled by the automatic regulator of angle in the angled wheel. In the fourth step, the compass device is placed or put on a desired surface on which a desired curve is to be drawn. The compass device is placed in such a way that the laser's emission line is aligned along the circular arc center, and the mark left by the tool is placed on the start point of curve. At the start point, the processor considers the value of zero for the parameter S. In the fifth step, the movement of the compass device is initiated or started. During the movement of the compass device, the N-coder or numerical coder or encoder is configured to provide the values of S and Ś to the microprocessor. Then the microprocessor is configured to send a suitable command to the motor driver of regulator of angle for the angled wheel based on the received values from the N coder or numerical coder. Thus the automatic regulator of angle is configured to change the angle of the angled wheel to a desired value at any instant. When the compass device is arrived or moved to at end point of curve, the device has been stop and the result has been desired curve.

According to one embodiment of the present invention, the surface including the contact points of the angled, fixed and balance wheels with the ground are arranged to be perpendicular to the symmetric surfaces of the guide wheels and parallel with the surface under the chassis. The symmetric surface of the chassis is arranged to be perpendicular to the symmetric surface of the fixed wheel and include the horizontal rotating axis of the angled wheel. The friction coefficient of the guide wheels is adjusted/varied to be large enough to prevent any sliding or gliding and thereby enabling a continuous rotation of the wheel. Further, the friction coefficient of the balance and the offset wheel are arranged to be smaller than that of the guide wheels. The profile of the guide wheels is semi-circle. According to an embodiment herein, the compass device achieves a higher precision or draws a curve with a higher precision, by increasing the diameter of the wheels. The offset axis is arranged to be perpendicular to the chassis.

According to one embodiment of the present invention, the calibration of the ruled section of the offset axis is carried out such that the ruled section shows the distance between the mark left by the tool and the contact point of the fixed guide wheel with the ground.

According to one embodiment of the present invention, the speed of start of device is set/designed to have a value to prevent or avoid any sliding movement between the guide wheels and the desired surface. The friction coefficient of friction wheels in the automatic controller/regulator of angle is set or adjusted to be large enough to prevent any sliding between them.

According to one embodiment of the present invention, the values of S and Ś are calculated for the mark left by the tool. In other words, S is a distance of the mark left by the tool from start point of curve and the value of Ś is a movement speed of the tool along a curved line. These values are calculated based on the feedback provided to and by the N-coder or numerical coder or encoder and the value of $\rho$.

Figure 10:
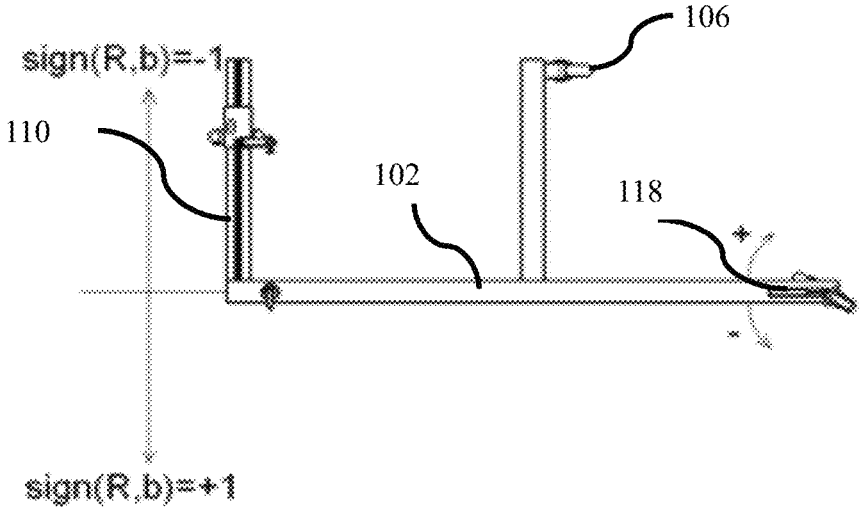
FIG. 10 illustrates a top side view of a compass indicating a true mark drawn when the horizontal axis of chassis is zero, according to an embodiment herein.

According to one embodiment of the present invention, the positive is direction of angle is arranged to be in clockwise direction. The horizontal axis of chassis is set to be zero. According to one embodiment of the present invention, the value of R is set to be positive when the center is placed as shown in FIG. 10 or otherwise to negative. This is true for the mark left by the tool and b.

The embodiments herein provide a compass device and a method for drawing arcs and circles without the need for accessing the center. The compass comprises a chassis, a first guide wheel, a second guide wheel, a protractor, an offset axis frame, an offset wheel, a laser index, a balance base, a balance wheel, a tool holder, and a marker.

According to an embodiment herein, the chassis is used for providing a framework for a plurality of other components of the compass.

According to an embodiment herein, the first guide wheel is used for initiating a movement of the compass. The first guide wheel is installed at one end of the chassis. According to an embodiment herein, the first guide wheel is referred as an angled wheel and the angle for the movement of the guide wheel is set by a user.

According to an embodiment herein, the second guide wheel is used for the movement of the compass. According to an embodiment herein, the second guide wheel is fixed.

According to an embodiment herein, the protractor is used for setting the angle for the first guide wheel. The protractor is mounted on the chassis.

According to an embodiment herein, the offset axis frame is used for providing a framework for a plurality of components of the compass. The offset axis frame is installed perpendicular to the chassis and next to the second guide wheel.

According to an embodiment herein, a tool holder is used for holding a marking device. The marking device is mounted on the offset axis frame and adjusted using an indicator. The tool holder is adjusted on the offset axis frame using a clip.

According to an embodiment herein, the offset wheel is used for providing a balance for the compass. The offset wheel is installed under the offset axis frame.

According to an embodiment herein, the laser index is used for identifying the desired parts of the arcs and circles. The laser index is mounted on the offset axis frame. Further, the laser index is placed at the symmetry center of the second guide wheel.

According to an embodiment herein, the balance base is used for maintaining the stability of the compass. The balance base is placed perpendicular to the chassis.

According to an embodiment herein, the balance wheel is attached to the balance base. The combination of the balance base and the balance wheel prevents the imbalance of the compass.

According to an embodiment herein, a marker is used for marking arcs and circles. The marker is inserted in a tool holder, and the position of the marker is adjusted by adjusting the tool holder.

According to an embodiment herein, the compass is used for drawing arcs and circles in a flat surface.

According to an embodiment herein, the compass is used for drawing arcs and circles in a relatively flat surfaces.

According to an embodiment herein, the offset axis frame includes a ruled groove, and the grooves on the offset axis are dependent on the scaling level of the compass.

The embodiments herein provide a compass for drawing arcs and circles without the need for accessing the center, the compass comprises a chassis, a first guide wheel, a second guide wheel, a protractor, an offset axis, an offset wheel, a laser index, a balance base, a balance wheel, a tool holder, and a marker.

According to an embodiment herein, the chassis is used for providing a framework for a plurality of other components of the compass.

According to an embodiment herein, the first guide wheel is used for initiating a movement of the compass. The first guide wheel is installed at one of the ends of the chassis. According to an embodiment herein, the first guide wheel is referred as an angled wheel and the angle for the movement of the guide wheel is set by a user.

According to an embodiment herein, the second guide wheel is used for the movement of the compass. According to an embodiment herein, the second guide wheel is a fixed wheel.

According to an embodiment herein, the protractor is used for setting the angle for the first guide wheel. The protractor is mounted on the chassis.

According to an embodiment herein, the offset axis is used for providing a framework for a plurality of components of the compass. The offset axis is installed perpendicular to the chassis and next to the second guide wheel.

According to an embodiment herein, a tool holder is used for holding a marking device. The marking device is mounted on the offset axis and adjusted using an indicator. The tool holder is adjusted on the offset axis using a clip.

According to an embodiment herein, the offset wheel is used for providing a balance for the compass. The offset wheel is installed under the offset axis.

According to an embodiment herein, the laser index is used for identifying the desired parts of the arcs and circles. The laser index is mounted on the offset axis. Further, the laser index is placed at the symmetry center of the second guide wheel.

According to an embodiment herein, the balance base is used for maintaining the stability of the compass. The balance base is placed perpendicular to the chassis.

According to an embodiment herein, the balance wheel is attached to the balance base. The combination of the balance base and the balance wheel prevents the imbalance of the compass.

According to an embodiment herein, a marker is used for marking arcs and circles. The marker is inserted in a tool holder, and the position of the marker is adjusted by adjusting the tool holder.

According to an embodiment herein, the compass is used for drawing arcs and circles in a flat surface.

According to an embodiment herein, the compass is used for drawing arcs and circles in a relatively flat surface.

According to an embodiment herein, the offset axis includes a ruled groove, and the grooves on the offset axis is dependent on the scaling level of the compass.

FIG. 1 illustrates an isometric view of a compass, according to an embodiment herein. The compass is used for drawing arcs and circles without the need for locating the center. The compass is used when there is an obstacle for reaching the center of the circle or the arc.

The compass comprises a chassis 102, a guide wheel 104, a guide wheel 105, a balance wheel 106, an offset wheel 108, an offset axis 110, a balance base 112, a tool holder 114, a laser index 116, a protractor 118, and a marker 120.

The arc or the circle is drawn on a flat surface or a relatively flat surface using the marker 120 of the compass. According to an embodiment herein, the compass works on a mechanism used in vehicles such as bicycle, motorcycle, and the like. The chassis 102 is similar to the chassis of the vehicles and two wheels.

The chassis 102 refers to a framework on which the guide wheel 104, the guide wheel 105, the laser index 116, and the protractor 118 are installed. The guide wheel 104 and the guide wheel 105 are installed at both the ends of the chassis 102. According to an embodiment herein, the guide wheel 104 is also referred to as an angled wheel. The guide wheel 104 is installed on the chassis with the help of attachments. The guide wheel 104 has the ability to change the angle of movement relative to the horizontal chassis 102. Further, a user of the compass has an option to adjust and fix the desired angle of the guide wheel 104 by measuring the angle through the protractor 118.

According to an embodiment herein, the guide wheel 105 is referred as a fixed wheel. The guide wheel 105 does not have the ability to change the angle relative to the horizontal axis of the chassis 102. Further, the guide wheel 105 is fixed to the chassis and does not move. Therefore, a rotating axis of guide wheel 105 is always perpendicular to the horizontal axis of the chassis 102.

The protractor 118 is mounted on the chassis 102. According to an embodiment herein, the protractor 118 is installed on a shaft of the guide wheel 104. The protractor 118 is used for adjusting the angle of the guide wheel 104. According to an embodiment herein, the protractor 118 is an analog protractor. According to an embodiment herein, the protractor 118 is a digital protractor. The user of the compass sets the angle for adjusting the guide wheel 104.

The offset axis 110 is a framework that is perpendicular to the horizontal axis of the chassis 102. The offset axis 110 is installed on the chassis 102 and next to the guide wheel 105. The tool holder 114 is mounted on the offset axis 110 and moved easily. According to an embodiment herein, the tool holder 114 is adjusted on the offset axis 110 using an indicator and is fixed using a clip. According to an embodiment herein, the offset axis 110 is used for regulating the distance between the tool holder 114 and the chassis 102.

Further, the offset axis 110 includes a ruled groove. According to an embodiment herein, the grooves on the offset axis 110 is dependent on the scale of the compass. For example, the grooves on the offset axis 110 are in terms of millimeter when the compass is used for constructing arcs and circles with small radius. In another example, the grooves on the offset axis 110 are in terms of centimeters and meters when the radius of the circle or the arc is very large.

The offset wheel 108 is installed at the offset axis 110. According to an embodiment herein, the offset wheel 108 provides a balance to the offset axis 110. According to an embodiment herein, the laser index 116 is installed on the upper side of the chassis 102. The laser index 116 is parallel to the rotation axis of the guide wheel 105. According to an embodiment herein, the laser index 116 is placed at the symmetry center of the guide wheel 105, due to which the surface of the laser index 116 and the symmetry center of the guide wheel 105 are perpendicular to the sides of the chassis 102. The arrangement of the laser index 116 as mentioned above ensures a placing of the arc towards a desired point.

According to an embodiment herein, the balance base 112 is installed on the center of the chassis 102. The balance base 112 comprises a cubic part and the balance wheel 106. The balance base 112 and the balance wheel 106 maintain the balance and stability of the device. Further, the balance base 112 and the balance wheel 106 prevent the compass from measuring wrong radius due to imbalance of the compass.

According to an embodiment herein, the balance base 112 is used for balancing the device and maintaining the symmetry plane of the guide wheel 104 perpendicular to the surface of the ground.

The tool holder 114 is mounted on the offset axis 110 for holding the marker 120. According to an embodiment herein, a maker 120 is installed on the offset axis 110. The examples of the marker tool includes, but are not limited to a cutting tool, a pencil, a jet burner, a permanent marker, a temporary marker, and the like. The marker 120 is adjusted in such a way that the mark left by the marker 120 falls along with the rotation axis of the guide wheel 105.

According to an embodiment herein, the chassis 102, the offset axis 110, the balance base 112 are made from rigid material. The example of the rigid material used for manufacturing the chassis 102, the offset axis 110, and the balance base 112 include but are not limited to a rectangular steel tube.

According to an embodiment herein, the base of the laser index 116, the tool holder 114, the inner part of the guide wheel 104, the guide wheel 105, the balance wheel 106, and the offset wheel 108 are made from butadiene-styrene.

According to an embodiment herein, the exterior part of the guide wheel 104, the guide wheel 105, the balance wheel 106, and the offset wheel 108 are made from material such as polyamide.

According to an embodiment herein, the material of each part of the compass is changed based on a purpose and is different for different purposes. The material used for constructing the compass is defined based on the working purposes of the compass. For example, the shape and the material of the compass used in the wood industry is different with the shape and material of the compass used in the field of the civil engineering.

Figure 2:
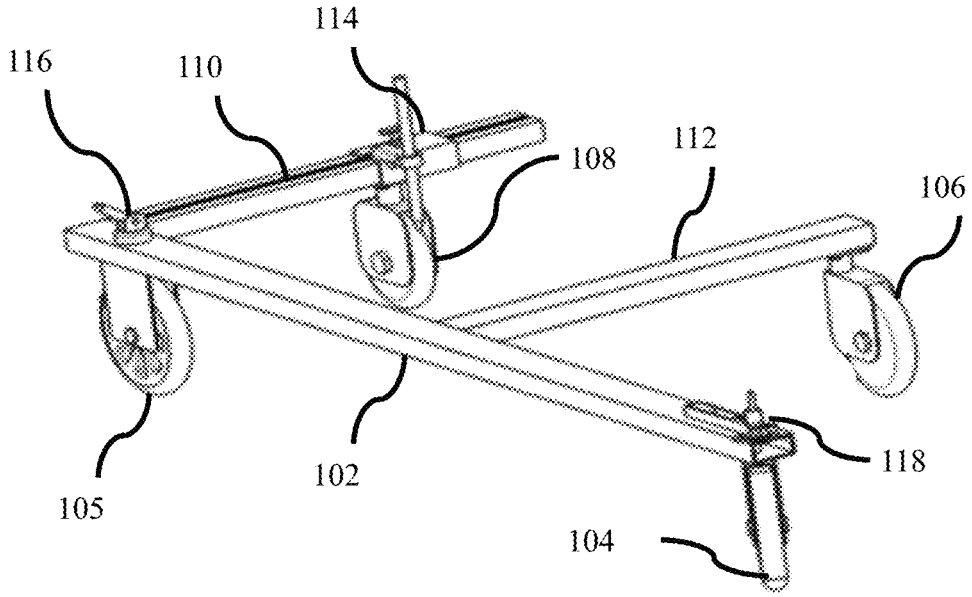
FIG. 2 illustrates a side view of the compass, according to an embodiment herein.

FIG. 2 illustrates a side view of the compass, according to an embodiment herein. The compass comprises the chassis 102, the guide wheel 104, the guide wheel 105, the balance wheel 106, the offset wheel 108, the offset axis 110, the balance base 112, the tool holder 114, the laser index 116, the protractor 118, and the marker 120.

Figure 3:
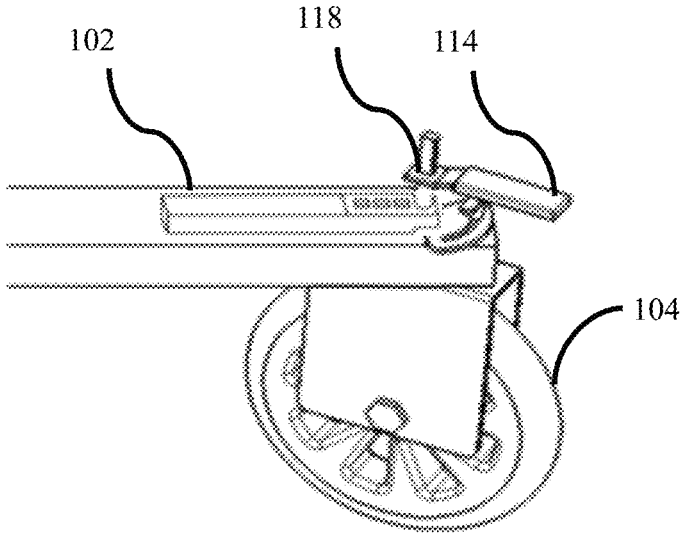
FIG. 3 illustrates a partial perspective view of a main frame mounted with a protractor and a guide wheel (angled wheel) in a compass device, according to an embodiment herein.

FIG. 3 illustrates a protractor mounted on a chassis installed to a shaft of an angled wheel, according to an embodiment herein. According to an embodiment herein, the protractor 118 is used for setting and measuring the angle at which the circle or an arc is drawn. The protractor 118 is used for setting and measuring the angle of the arc. According to an embodiment herein, the guide wheel 104 is capable of rotating. The angle of the rotation of the guide wheel 104 is equivalent to the angle set by the protractor 118. According to an embodiment herein, the protractor 118 regulates the angle of the guide wheel 104.

Figure 4:
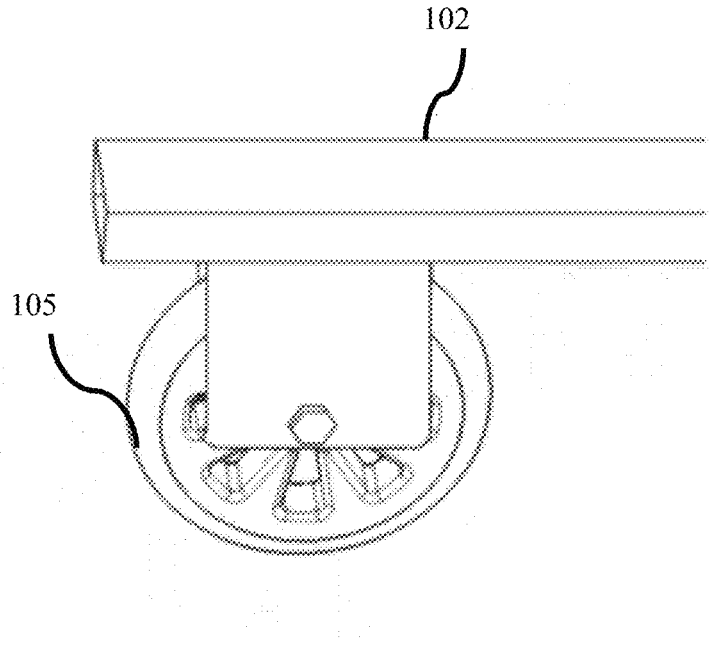
FIG. 4 illustrates a partial perspective view of a main frame mounted with a guide wheel (fixed wheel) in the compass device, according to an embodiment herein.

FIG. 4 illustrates a guide positioned relative to a rotating axis of the chassis of the compass, according to an embodiment herein. According to an embodiment herein, the guide wheel 105 is installed perpendicular to the chassis 102. The guide wheel 105 is referred as the fixed wheel. According to an embodiment, the guide wheel 105 does not move according to the change in the angles of the protractor 118.

Figure 5A:
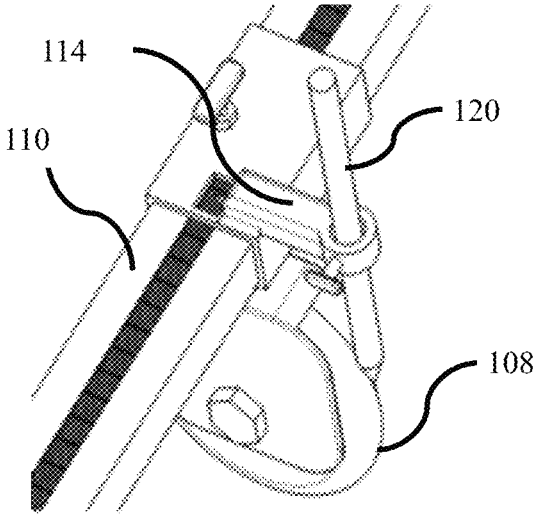
FIG. 5A and FIG. 5B illustrate a top side view of a tool holder mounted on an offset axis frame provided with an offset wheel in the compass device, according to an embodiment herein.
Figure 5B:
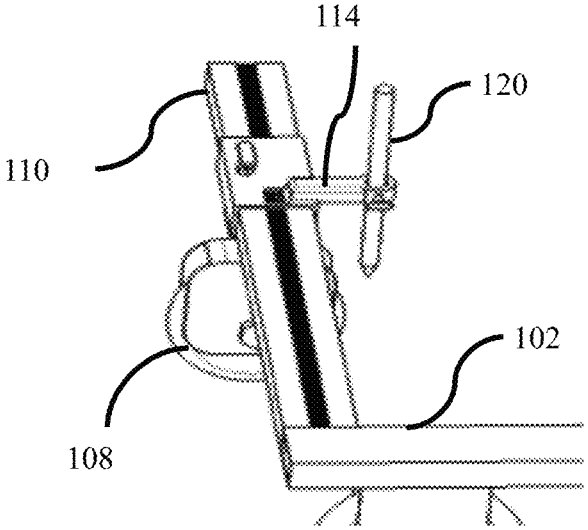

FIG. 5A and FIG. 5B illustrate a side view of a tool holder mounted on an offset axis, according to an embodiment herein. According to an embodiment herein, the marker 120 is placed inside a tool holder 114 for marking the arcs and circles without the need for the compass to locate the center. The tool holder 114 is attached to the offset axis 110. According to an embodiment herein, the tool holder 114 is attached to the offset axis 110 using a plurality of clips.

Figures 6A, 6B:
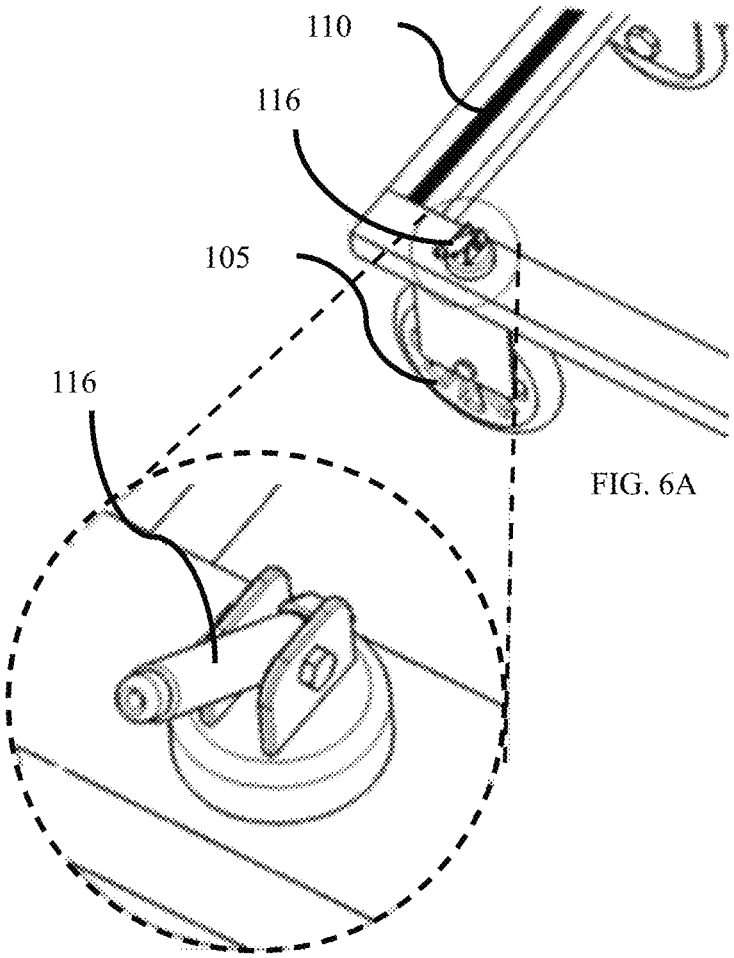
FIG. 6A illustrates a topside view a line laser mounted on a rotational axis of a fixed wheel in the compass device, according to an embodiment herein.
FIG. 6B illustrates an enlarged top side view of the line laser mounted on a rotational axis of a fixed wheel in the compass device, according to an embodiment herein.

FIG. 6A and FIG. 6B illustrate a line laser mounted on a rotational axis of a fixed wheel, according to an embodiment herein. The laser index 116 is installed on the upper side of the chassis 102. The laser index 116 is placed on the symmetry center of the guide wheel 104, which helps the compass to balance and aligns the radius of the arc towards the desired point. The laser index 116 is used for aligning the radius of the arc with a desired point or a line.

According to an embodiment herein, the laser index 116 is installed on the chassis 102 such a way that the emission line of the laser index 116 is parallel to the direction of the arc. The laser index 116 is used to align the direction of the radius with the desired direction or the desired point. According to an embodiment herein, for the initial construction of the arc or the circle, the compass is placed on the desired surface and is pushed to draw the arc or the circle. However, when the compass is placed on the desired surface, the arc or the circle is drawn in a plurality of directions. According to an embodiment herein, the laser index 116 is used for deciding the direction of the radius.

According to an embodiment herein, the maximum distance the laser index 116 points is greater than the maximum radius of the compass. According to an embodiment herein, the laser index 116 that is also known as the "laser pointer distance measure" is used in the compass for providing working range greater than the actual range of the compass.

Figure 7:
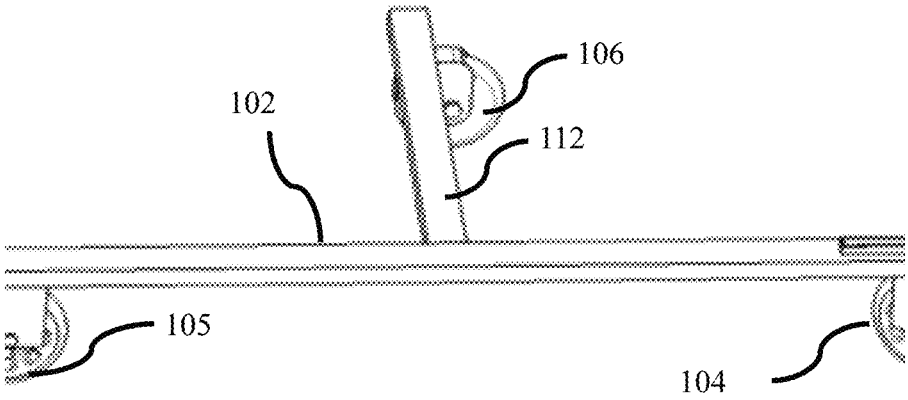
FIG. 7 illustrates a topside perspective view of a balance base installed on a middle of a chassis, according to an embodiment herein.

FIG. 7 illustrates a balance base installed on a middle of a chassis, according to an embodiment herein. According to an embodiment herein, the balance base 112 is installed perpendicular to the chassis 102. The balance wheel 106 is used for providing balance to the compass.

Figure 8:
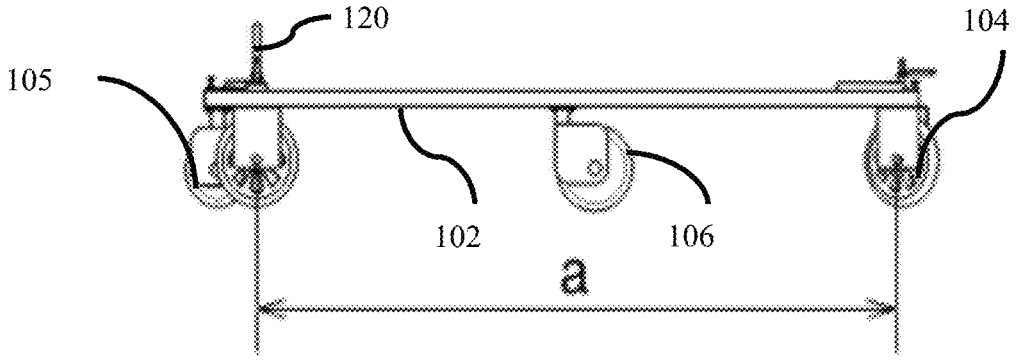
FIG. 8 illustrates a front view of a compass device indicating a distance between symmetry centers of two guide wheels, according to an embodiment herein.

FIG. 8 illustrates a distance between symmetry centers of two guide wheels, according to an embodiment herein. The FIG. 8 illustrates the construction of a circle or an arc without the need for locating the center. According to an embodiment herein, each arc or circle has a radius and a center. The distance between the symmetry center of the guide wheel is a constant which is equal to "a". According to an embodiment herein, the "a" of the compass is dependent on the utility of the compass in a plurality of industries. For example, the "a" of the compass is relatively small when used for construction of arcs and circles for drawing purposes. In another example, the "a" of the compass is relatively larger when the construction of arcs and circles is for industrial and professional construction purposes.

Figure 9:
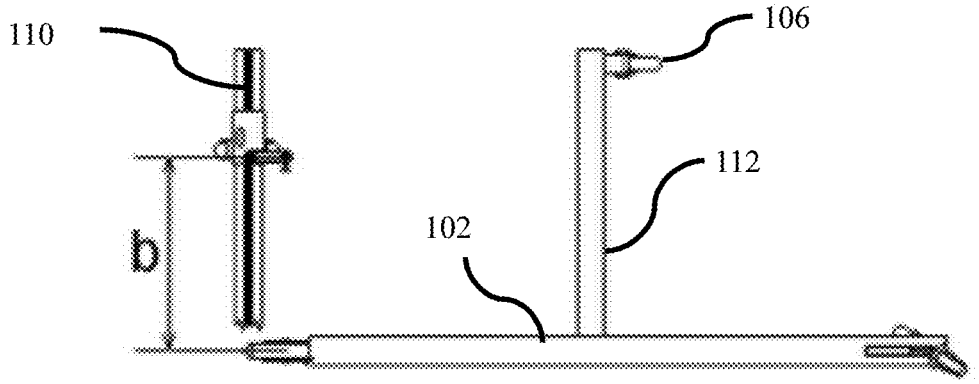
FIG. 9 illustrates a top side view of a compass indicating a distance of mark drawn by the tool from the symmetric center of the fixed guide wheels, according to an embodiment herein.

FIG. 9 illustrates a distance of mark drawn by the tool from the symmetric center of the fixed guide wheels, according to an embodiment herein. According to an embodiment herein, the distance of the mark left by the tools from the symmetric center of the guide wheel 105 is equal to "b". The value of the "b" is adjusted according to the needs of the construction of the arc or the circle.

Further, the guide wheel 104 is adjusted and fixed in the angle of "$\alpha$". According to an embodiment herein, the angle of "$\alpha$" is calculated using the relation:

$$\alpha = \tan^{-1}\left(\frac{a}{R+b}\right)$$

According to an embodiment herein, the angle of "α" is set in a clockwise direction. "R" is the radius of the arc or circle. Further, the horizontal axis of the chassis is set to zero. According to an embodiment herein, the angle of "α" and the angle of the axis with respect to the chassis 102 is set according to the requirements of the construction and the user. According to an embodiment herein, when the angle of "α" is positive, the arc or the circle is drawn in a clockwise direction. According to an embodiment herein, when the angle of "α" is negative, the arc or the circle is drawn in anticlockwise direction.

FIG. 10 illustrates a true mark drawn when the horizontal axis of chassis is zero, according to an embodiment herein. The FIG. 10 illustrates the true mark drawn by the compass when the compass is set with an angle of "α". According to an embodiment herein, the true mark left from the compass is either above or below the surface of the compass which is determined using the angle of "α".

Further, after adjusting the angle of "α", the compass is placed on the desired spot in a way that the emission line of the laser index 116 is along the circular arc center, and the mark left by the compass is placed on the desired arc. Once the compass is placed on the desired spot, the geometric position of the mark is the desired arc. According to an embodiment herein, the compass has maximum efficiency when the arcs and circles are constructed for the flat and relatively flat surfaces.

Figure 11:
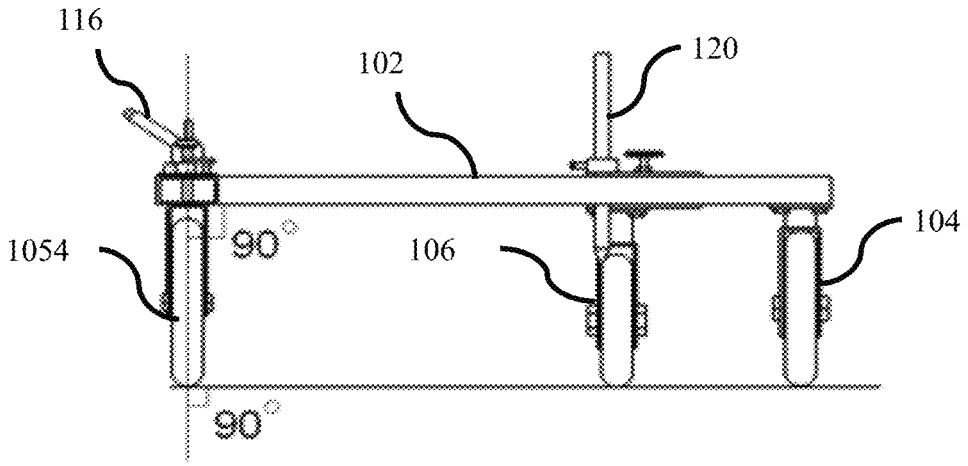
FIG. 11 illustrates a front side view of a compass indicating a guide wheel, a balance wheel, and a fixed wheel perpendicular to the surface of a ground, according to an embodiment herein.

FIG. 11 illustrates a guide wheel, a balance wheel, and a fixed wheel perpendicular to the surface of a ground, according to an embodiment herein. According to an embodiment herein, the surface of the ground including the contact points of the guide wheel 104, the guide wheel 105 and balance wheel 106 is perpendicular to the symmetric surfaces of the guide wheel 104 and the guide wheel 105. Further, the symmetric surfaces of the guide wheel 104 and the guide wheel 105 is parallel to the surface under the chassis 102.

According to an embodiment herein, the symmetric surface of the chassis 102 is perpendicular to the symmetric surface of the guide wheel 105 and include the horizontal rotating axis of the guide wheel 104.

Further, the friction co-efficient of the guide wheel 104 and the guide wheel 105 is large enough to prevent any sliding or gliding. According to an embodiment herein, the friction co-efficient of the guide wheel 104 and the guide wheel 105 ensure the continuous rotation of the guide wheel 104 and the guide wheel 105. According to an embodiment herein, the friction co-efficient of the balance wheel 106 and the offset wheel 108 is smaller than that of the guide wheel 104 and the guide wheel 105.

According to an embodiment herein, the profile of the guide wheel 104 and the guide wheel 105 is a semi-circle. According to an embodiment herein, with the increase in the diameter of the guide wheel 104, the guide wheel 105, the balance wheel 106, and the offset wheel 108, the compass provides a high precision.

According to an embodiment herein, the offset axis 110 is perpendicular to the chassis 102. Further, the calibration of the ruled section of the offset axis 110 should be perpendicular to the chassis 102. Further, the calibration of the ruled section of the offset axis is carried out such that the ruled section indicates the distance between the marks left by the compass and the contact point of the guide wheel 104 with the ground.

According to an embodiment herein, the usage range of the compass is dependent on factors influencing the degree of the arc radius, such as the distance between the guide wheel 104 and the guide wheel 105, and the angle of the guide wheel 105. According to an embodiment herein, for calculating the range of the compass, the following formula is used m=r/a.

According to an embodiment herein, where for each r, there is a certain amount of "m"; therefore, with the increase of r, m is increased. According to an embodiment herein, when b=0 and a=1, then m is equal to 57.2899, i.e., by one degree of deviation in the angle, the arc radius "r" is approximately equal to 57.2899 times the distance between the guide wheel 104 and the guide wheel 105. According to an embodiment herein, the compass has a negligible amount of error.

According to an embodiment herein, improving the precision of the protractor 118 and manufacturing decreases the amount of error. Further, the precision of the compass increases when the angle is more one degree. According to an embodiment herein, the compass is operated as a ruler by setting the angle at zero.

According to an embodiment herein, an N(numeric)-coder is added to the guide wheel 104 and by using the same, a length value of each arc is controlled so that the length value of the arcs are up to the desired value.

According to an embodiment herein, an option to add a laser index is provided to the tool holder to draw an arc that passes from the desired point.

Figure 12:
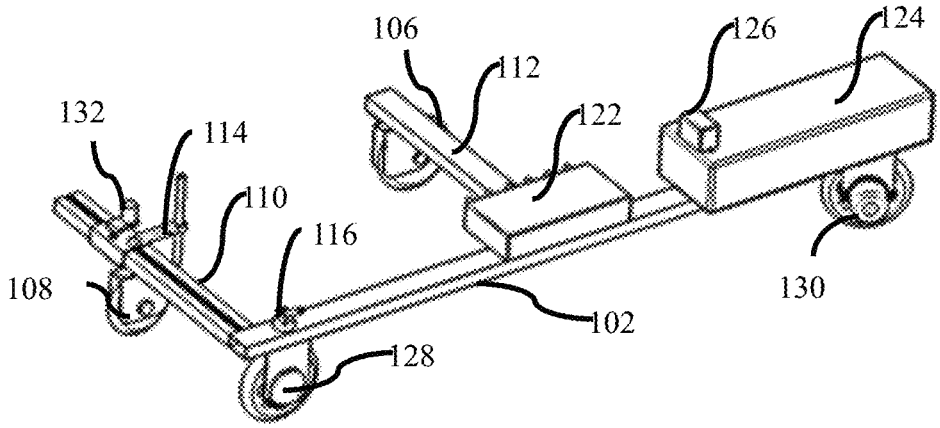
FIG. 12 illustrates a top side perspective view of a compass device, for drawings arcs with variable radius of curvature at an instant, according to an embodiment herein.

FIG. 12 illustrates a top side perspective view of a compass device, for drawings arcs with variable radius of curvature at an instant, according to an embodiment herein with respect to FIG. 12, the compass device. The compass comprises a chassis 102, a first guide wheel, a second guide wheel, a balance wheel 106, an offset wheel 108, an offset axis 110, a balance base 112, a tool holder 114, a laser index 116, a protractor, a marker 120, an automatic regulator of tool holder for positioning on offset axis frame 132, a controller system (microprocessor) 122, friction gear box 124, and an angle of curve regulator/controller for angled guide wheel.

The arc or the circle is drawn on a flat surface or a relatively flat surface using the marker 120 of the compass. According to an embodiment herein, the compass works on a mechanism used in vehicles such as bicycle, motorcycle, and the like. The chassis 102 is similar to the chassis of the vehicles and two wheels.

The chassis 102 refers to a framework on which the first guide wheel, the second guide wheel, the laser index 116, and the protractor are installed. The first guide wheel and the second guide wheel are installed at both the ends of the chassis 102. According to an embodiment herein, the first guide wheel is also referred to as an angled wheel. The first guide wheel is installed on the chassis with the help of attachments. The first guide wheel has the ability to change the angle of movement relative to the horizontal chassis 102. Further, a user of the compass has an option to adjust and fix the desired angle of the first guide wheel by measuring the angle through the protractor.

According to an embodiment herein, the second guide wheel is referred as a fixed wheel. The second guide wheel does not have the ability to change the angle relative to the horizontal axis of the chassis 102. Further, the second guide wheel is fixed to the chassis and does not move. Therefore, a rotating axis of the second guide wheel is always perpendicular to the horizontal axis of the chassis 102.

The protractor is mounted on the chassis 102. According to an embodiment herein, the protractor is installed on a shaft of the first guide wheel. The protractor is used for adjusting the angle of the first guide wheel. According to an embodiment herein, the protractor is an analog protractor. According to an embodiment herein, the protractor is a digital protractor. The user of the compass sets the angle for adjusting the first guide wheel.

The offset axis 110 is a framework that is perpendicular to the horizontal axis of the chassis 102. The offset axis 110 is installed on the chassis 102 and next to the second guide wheel. The tool holder 114 is mounted on the offset axis 110 and moved easily. According to an embodiment herein, the tool holder 114 is adjusted on the offset axis 110 using an indicator and is fixed using a clip. According to an embodiment herein, the offset axis 110 is used for regulating the distance between the tool holder 114 and the chassis 102.

Further, the offset axis 110 includes a ruled groove. According to an embodiment herein, the grooves on the offset axis 110 is dependent on the scale of the compass. For example, the grooves on the offset axis 110 are in terms of millimeter when the compass is used for constructing arcs and circles with small radius. In another example, the grooves on the offset axis 110 are in terms of centimeters and meters when the radius of the circle or the arc is very large.

The offset wheel 108 is installed at the offset axis 110. According to an embodiment herein, the offset wheel 108 provides a balance to the offset axis 110. According to an embodiment herein, the laser index 116 is installed on the upper side of the chassis 102. The laser index 116 is parallel to the rotation axis of the second guide wheel. According to an embodiment herein, the laser index 116 is placed at the symmetry center of the second guide wheel, due to which the surface of the laser index 116 and the symmetry center of the second guide wheel are perpendicular to the sides of the chassis 102. The arrangement of the laser index 116 as mentioned above ensures a placing of the arc towards a desired point.

According to an embodiment herein, the balance base 112 is installed on the center of the chassis 102. The balance base 112 comprises a cubic part and the balance wheel 106. The balance base 112 and the balance wheel 106 maintain the balance and stability of the device. Further, the balance base 112 and the balance wheel 106 prevent the compass from measuring wrong radius due to imbalance of the compass.

According to an embodiment herein, the balance base 112 is used for balancing the device and maintaining the symmetry plane of the first guide wheel perpendicular to the surface of the ground.

The tool holder 114 is mounted on the offset axis 110 for holding the marker 120. According to an embodiment herein, a maker 120 is installed on the offset axis 110. The examples of the marker tool includes, but are not limited to a cutting tool, a pencil, a jet burner, a permanent marker, a temporary marker, and the like. The marker 120 is adjusted in such a way that the mark left by the marker 120 falls along with the rotation axis of the second guide wheel.

According to an embodiment herein, the chassis 102, the offset axis 110, the balance base 112 are made from rigid material. The example of the rigid material used for manufacturing the chassis 102, the offset axis 110, and the balance base 112 include but are not limited to a rectangular steel tube.

According to an embodiment herein, the base of the laser index 116, the tool holder 114, the inner part of the first guide wheel, the second guide wheel, the balance wheel 106, and the offset wheel 108 are made from butadiene-styrene.

According to an embodiment herein, the exterior part of the first guide wheel, the second guide wheel, the balance wheel 106, and the offset wheel 108 are made from material such as polyamide.

According to an embodiment herein, the material of each part of the compass is changed based on a purpose and is different for different purposes. The material used for constructing the compass is defined based on the working purposes of the compass. For example, the shape and the material of the compass used in the wood industry is different with the shape and material of the compass used in the field of the civil engineering.

According to an embodiment herein, a controller for tool holder position 132 is provided on the offset axis frame. The automatic controller for tool holder position on the offset axis frame is mounted on the tool holder. The automatic controller for tool holder position comprises a sensor and a first drive motor, and wherein the automatic controller for tool holder position on the offset axis frame is configured to control an operation of the first drive motor to move the tool holder to a desired position on the offset axis frame based on an output of the sensor;

According to an embodiment herein, a controller 126 for the angled wheel is provided. The controller 126 for angled wheel is mounted on the chassis above the angle wheel. The controller for angled wheel is configured to vary an angle of the angled wheel continuously to change a curvature of radius at every instant in a curve. The controller for the angled wheel comprises a second drive motor and a friction gear box 124.

According to an embodiment herein, an encoder or numerical coder 128 is mounted on the second guide wheel and configured to calculate a longitude or length of a curved line to calculate a curvature of radius at every instant.

According to an embodiment herein, a microcontroller 122 is mounted on the chassis and configured to control an operation of compass device to draw a desired curve.

Figure 13:
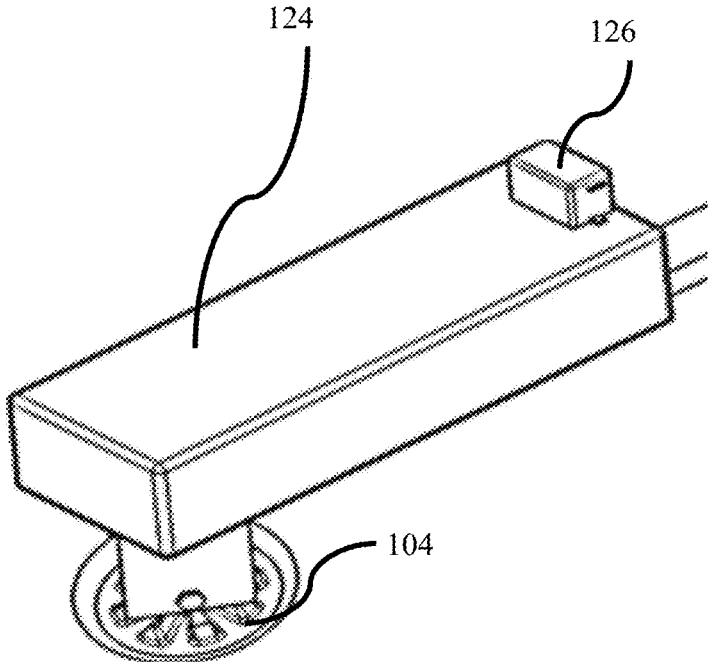
FIG. 13 illustrates a top side perspective view of an automatic regulator and controller for varying an angle of the angled wheel at an instant in a compass device, according to an embodiment herein.

FIG. 13 illustrates a top side perspective view of an automatic regulator and controller for varying an angle of the angled wheel at an instant in a compass device, according to an embodiment herein. With respect to FIG. 13, a controller 126 for the angled wheel 104 is provided. The controller 126 for angled wheel is mounted on the chassis above the angle wheel. The controller for angled wheel is configured to vary an angle of the angled wheel continuously to change a curvature of radius at every instant in a curve. The controller for the angled wheel comprises a second drive motor and a friction gear box 124.

Figure 14:
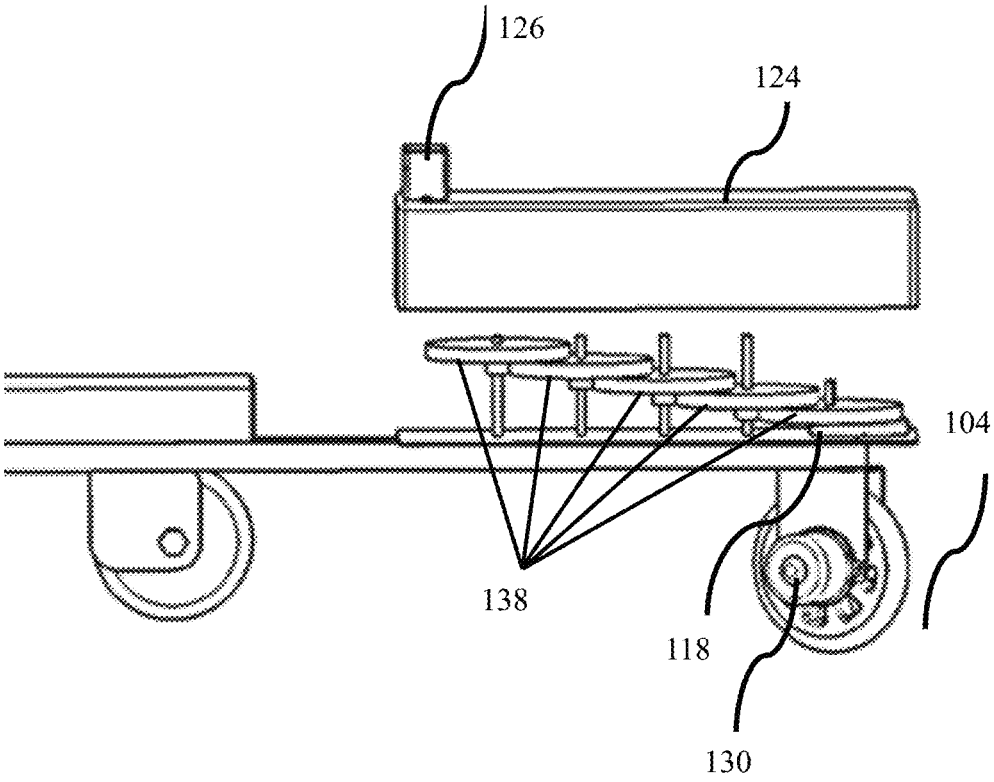
FIG. 14 illustrates an exploded side view of an automatic regulator and controller for varying an angle of the angled wheel at an instant in a compass device, according to an embodiment herein.

FIG. 14 illustrates an exploded side view of an automatic regulator and controller for varying an angle of the angled wheel at an instant in a compass device, according to an embodiment herein. With respect to FIG. 14, a controller 126 for the angled wheel 104 is provided. The controller 126 for angled wheel is mounted on the chassis above the angle wheel. The controller for angled wheel is configured to vary an angle of the angled wheel continuously to change a curvature of radius at every instant in a curve. The controller for the angled wheel comprises a second drive motor and a friction gear box 124. The second drive motor 130 is operated to vary the angle of the angled wheel 104. The controller for the angled wheel is configured to control an operation of the second drive motor 130 to vary the angle of the wheel at every instant. The protractor 118 is configured to provide a feedback of the angle of the angled wheel to the controller 126. The friction gear box 124 comprises a plurality of friction gear wheels 138 to select a friction of the angled wheel to change the angle of the angled wheel without any vibration and sliding movement.

Figure 15:
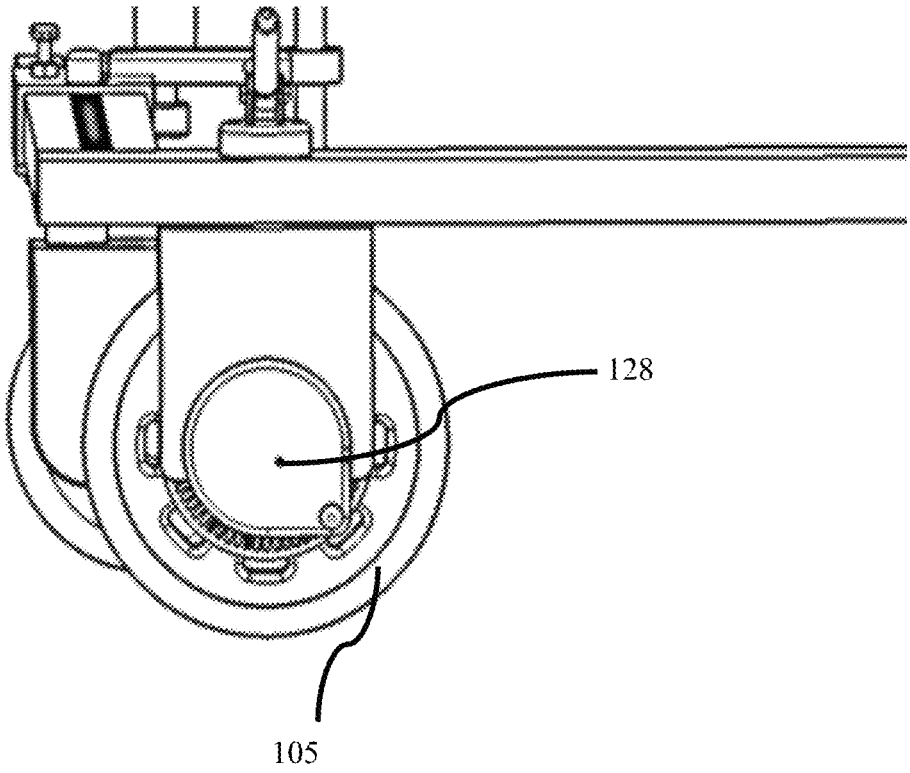
FIG. 15 illustrates a side view of an encoder or Numerical coder attached to fixed guide wheel in a compass device for drawings arcs with variable radius of curvature at an instant, according to an embodiment herein.
Figure 16:
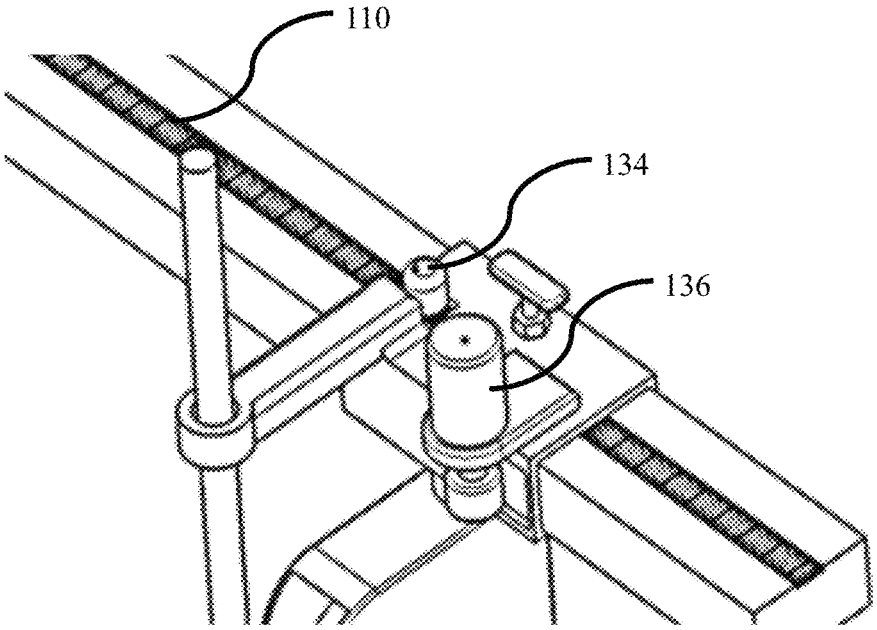
FIG. 16 illustrates a top side view of an automatic regulator/controller for tool holder position on the offset axis frame in a compass device for drawings arcs with variable radius of curvature at an instant, according to an embodiment herein.

FIG. 15 illustrates a side view of an encoder or Numerical coder attached to fixed guide wheel in a compass device for drawings arcs with variable radius of curvature at an instant, according to an embodiment herein. With respect to FIG. 15, the encoder or numerical coder 128 mounted on the guide wheel 105 and configured to calculate a longitude or length of a curved line to calculate a curvature of radius at every instant FIG. 16 illustrates a top side view of an automatic regulator/controller for tool holder position on the offset axis frame in a compass device for drawings arcs with variable radius of curvature at an instant, according to an embodiment herein. With respect to FIG. 16, a controller for tool holder position on the offset axis frame is provided. The automatic controller for tool holder position on the offset axis frame is mounted on the tool holder. The automatic controller for tool holder position comprises a sensor 134 and a first drive motor 136. The automatic controller for tool holder position on the offset axis frame is configured to control an operation of the first drive motor to move the tool holder to a desired position on the offset axis frame 110 based on an output of the sensor. The sensor in the automatic controller for tool holder position on the offset axis frame is configured to detect a position of the tool holder on the offset axis frame. The automatic controller for tool holder position on the offset axis frame is further configured to calculate a movement speed of the tool holder on the offset axis frame.

Figure 17:
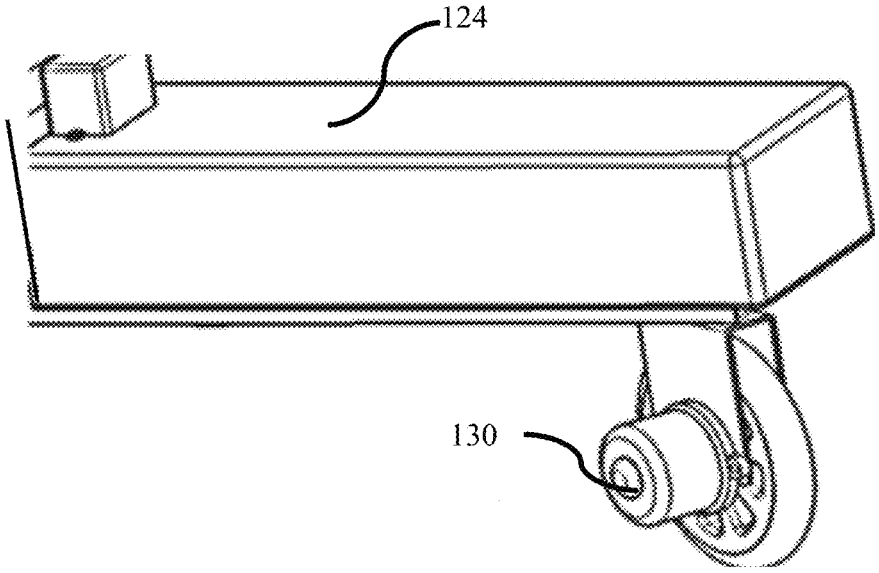
FIG. 17 illustrates a side view of a drive motor mounted on the angled wheel in a compass device for drawings arcs with variable radius of curvature at an instant, according to an embodiment herein.

FIG. 17 illustrates a side view of a drive motor mounted on the angled wheel in a compass device for drawings arcs with variable radius of curvature at an instant, according to an embodiment herein. With respect to FIG. 17. The controller for the angled wheel comprises a second drive motor 130 and a friction gear box 124. The second drive motor is mounted on the angled wheel. The second drive motor 130 is operated to vary the angle of the angled wheel. The controller for the angled wheel is configured to control an operation of the second drive motor 130 to vary the angle of the wheel at every instant.

According to an embodiment herein, by adding additional devices, the compass draws curve on the flat surfaces, due to which the amount of radius and the place of the center arc in any instant a plurality of relatively small consecutive tangent arcs are drawn.

According to an embodiment herein, by installing two electric motors to the first guide wheel and the second guide wheel, and installing a servomotor to the protractor and then controlling the compass by a microcontroller, the compass is configured to draw a desired curve. According to an embodiment herein, the compass has the capability to carry out the work of the 2D computer numerical control (CNC) machine in large scale without the need to have an external framework.

According to an embodiment herein, the compass is used for drawing circles and arcs when there is no access to the circular arc center.

According to an embodiment herein, the compass is used when the radius of the arc is very large for a conventional compass.

According to an embodiment herein, the compass is used when the circular arc center is suspended in space.

According to an embodiment herein, the compass is used without the need to be controlled by an external framework.

According to an embodiment herein, the compass is used to draw a long straight line by setting the angle at zero.

According to an embodiment herein, the compass allows drawing a plurality of tangent arcs in a row, and producing a variety of curves. Since the compass operates without the need to have access to the circular arc center, the radius and the center co-ordinates are changed in a short time.

According to an embodiment herein, the compass is used for drawing a full circle.

According to an embodiment herein, the compass is operated and handled by a single person, when the size is relatively smaller.

According to an embodiment herein, the compass is used as a ruler by setting the horizontal axis of the chassis is set to zero degree.

According to an embodiment herein, the compass structure is simple and is user-friendly.

According to an embodiment herein, the simple structure of the device ensures the economical production cost.

According to an embodiment herein, resources such as time, energy, and labor are saved by using the compass for drawing arcs and circles.

According to an embodiment herein, the precision and the usage range of the device depends on the precision of regulator of angle of angled wheel, the precision of N-coder, and a construction precision of chassis. When the distance between the guide wheels is determined by parameter a, then the precision of N-coder and the construction precision of chassis should be value of 0.001a. The precision of regulator of angle is arranged to be at least $1' = 1/60$ degrees.

According to an embodiment herein, the usage range of this compass device is infinite or unlimited, so that any curve is drawn by this device easily and automatically. This compass device is configured to draw each/any curve on flat surfaces without need to be controlled by external framework. This compass device is configured to draw a straight line, a full circle and other multiple curves. This compass device is very economical because this compass device does not need to be controlled by external frame work. This compass device is configured to draw any curve quickly and automatically thereby saving time, energy and resources. This compass device has simple structure thereby reducing the cost. Further the compass device is designed to be user friendly. By using this compass device, a lot of work place is saved because the compass device does not need to be controlled by external frame work. By using this compass device, a lot of energy has been saved. The compass device is very much economical.

The compass device of the embodiments herein falls under the category of light machinery, and heavy machinery depending on the scale of its production. This compass device is manufactured in different sizes and used in diverse areas. This compass device is used in different industries such as civil engineering, road construction, tankage construction, sheet metal industry, welding, wood industry, and architecture.

According to one embodiment herein, this device compass is configured to draw curves in uneven surfaces without need to be controlled by external framework by adding some equipment.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A compass device for drawing arcs and circles without a need for accessing the center, the compass comprises:

a chassis for providing a framework for a plurality of components of the compass;

a first guide wheel for initiating a movement of the compass, wherein the first guide wheel is installed at one end of the chassis, and wherein the first guide wheel is an angled wheel, and wherein the angle of the first guide wheel is set by a user;

a second guide wheel for enabling a movement of the compass, wherein the second guide wheel is attached to another end of the chassis, and wherein the second guide wheel is a fixed wheel;

a protractor for setting an angle for the first guide wheel, and wherein the protractor is mounted on the chassis;

an offset axis frame for providing a framework for a plurality of components of the compass, wherein the offset axis frame is installed perpendicular to the chassis next to the second guide wheel;

a tool holder for holding a marking device, wherein the tool holder is mounted on the offset axis frame, and wherein the tool holder is adjusted on the offset axis frame using an indicator, and wherein the tool holder is adjusted on the offset axis frame using a clip;

an offset wheel for providing a balance for the compass, and wherein the offset wheel is installed under the offset axis frame;

a laser pointer for identifying a desired part of the arcs and circles, wherein the laser pointer is mounted on the offset axis frame, and wherein the laser pointer is placed at a symmetry center of the second guide wheel;

a balance base for maintaining a stability of the compass, and wherein the balance base is perpendicular to the chassis;

a balance wheel attached to the balance base, wherein the balance wheel is installed under the balance base, wherein the balance base and the balance wheel are configured to prevent an imbalance of the compass;

a marker for marking the arcs and circles, wherein the marker is inserted in a tool holder, and wherein the marker is controlled by adjusting the tool holder;

a controller for tool holder position on the offset axis frame, wherein the automatic controller for tool holder position on the offset axis frame is mounted on the tool holder, and wherein the automatic controller for tool holder position comprises a sensor and a first drive motor, and wherein the automatic controller for tool holder position on the offset axis frame is configured to control an operation of the first drive motor to move the tool holder to a desired position on the offset axis frame based on an output of the sensor;

a controller for the angled wheel, wherein the controller for angled wheel is mounted on the chassis above the angle wheel, and wherein the controller for angled wheel is configured to vary an angle of the angled wheel continuously to change a curvature of radius at every instant in a curve, and wherein the controller for the angled wheel comprises a second drive motor and a friction gear box;

an encoder or numerical coder mounted on the first guide wheel and configured to calculate a longitude or length of a curved line to calculate a curvature of radius at every instant; and a microcontroller mounted on the chassis and configured to control an operation of compass device to draw a desired curve.

2. The compass according to claim 1, wherein the compass is used for drawing arcs and circles for a flat surface.

3. The compass according to claim 1, wherein the compass is used for drawing arcs and circles in a relatively flat surface.

4. The compass according to claim 1, wherein the offset axis frame includes a ruled groove, and wherein the ruled groove on the offset axis frame is dependent on a scale of the compass.

5. The compass according to claim 1, wherein the first guide wheel and the second guide wheel are installed using standard welding techniques.

6. The compass according to claim 1, wherein the offset axis frame is configured to regulate a distance between the tool holder and the chassis.

7. The compass according to claim 1, wherein the laser pointer is configured for aligning the radius of the arc with a desired point.

8. The compass according to claim 1, wherein the balance base and the balance wheel are configured for balancing the compass.

9. The compass according to claim 1, wherein the balance base and the balance wheel are configured to maintain a symmetry plane of the guide wheel perpendicular to a surface of the ground.

10. The compass according to claim 1, wherein a profile of the first guide wheel and the second guide wheel is semi-circular.

11. The compass according to claim 1, wherein the ruled groove has a ruled section and wherein the ruled section is calibrated to indicate a distance between a mark left by the tool and a contact point of the second guide wheel with a ground surface.

12. The compass according to claim 1, wherein a range of the compass is calculated using a formula $m=r/a$, wherein m is a multiplication factor, r is a radius of arc or circle and a is a distance between a symmetry center of the first guide wheel and the second guide wheel, and wherein the value of m is equal to 57.2899.

13. The compass according to claim 1, wherein the laser pointer is installed on the chassis in such a way that an emission line of the laser pointer is parallel to a direction of radius of the arc.

14. The compass according to claim 1, wherein the sensor in the automatic controller for tool holder position on the offset axis frame is configured to detect a position of the tool holder on the offset axis frame.

15. The compass according to claim 1, wherein the second drive motor is operated to vary the angle of the angled wheel, wherein the controller for the angled wheel is configured to control an operation of the second drive motor to vary the angle of the wheel at every instant.

16. The compass according to claim 1, wherein the protractor is configured to provide a feedback of the angle of the angled wheel to the controller.

17. The compass according to claim 1, wherein the friction gear box comprises a plurality of friction gear wheels to select a friction of the angled wheel to change the angle of the angled wheel without any vibration and sliding movement.

18. The compass according to claim 1, wherein the automatic controller for tool holder position on the offset axis frame is further configured to calculate a movement speed of the tool holder on the offset axis frame.

* * * * *